US005445328A

United States Patent [19]

Musselman

[11] Patent Number: 5,445,328

[45] Date of Patent: Aug. 29, 1995

[54] DUAL ZONE REFINER WITH SEPARATED DISCHARGE FLOW CONTROL

[75] Inventor: Ronald L. Musselman, Lewisburg, Pa.

[73] Assignee: Andritz Sprout-Bauer, Inc., Muncy, Pa.

[21] Appl. No.: 111,632

[22] Filed: Aug. 25, 1993

[51] Int. Cl.[6] ..... B02C 25/00; B02C 07/14

[52] U.S. Cl. ..... 241/37; 241/245; 241/259; 241/259.1; 241/261.1; 241/146

[58] Field of Search ..... 241/33, 37, 245, 259, 241/259.1, 259.2, 261.1, 261.2, 261.3, 146

[56] References Cited

U.S. PATENT DOCUMENTS

| | | | |
|---|---|---|---|
| 200,722 | 2/1878 | Hess | 241/146 X |
| 220,626 | 10/1879 | Leavitt | 241/146 X |
| 1,762,379 | 6/1930 | Bates | 241/146 X |
| 2,051,716 | 8/1936 | Johnson | 241/146 X |
| 2,412,680 | 12/1946 | Fisher et al. | 241/146 X |
| 2,437,147 | 2/1948 | Zwoyer | 241/245 X |
| 3,323,731 | 6/1967 | Asplund et al. | 241/146 |
| 3,754,714 | 8/1973 | Reinhall | 241/37 X |
| 3,822,828 | 7/1974 | Spitz | 241/37 X |
| 4,700,900 | 10/1987 | Rowland | 241/37 |
| 4,783,014 | 11/1988 | Fredriksson . | |
| 4,820,980 | 4/1989 | Dodson-Edgars | 241/37 X |
| 5,076,892 | 12/1991 | Fisher et al. . | |
| 5,127,591 | 7/1992 | Bernhard et al. . | |

FOREIGN PATENT DOCUMENTS

| | | | |
|---|---|---|---|
| 393519 | 11/1991 | Australia . | |
| 2108704 | 5/1972 | France . | |
| 1104317 | 4/1961 | Germany . | |
| 778785 | 11/1980 | U.S.S.R. | 241/245 |
| 88/08957 | 11/1988 | WIPO . | |
| 91/01406 | 2/1991 | WIPO . | |

OTHER PUBLICATIONS

Notification of Transmittal of the International Search Report for International Application No. PCT/US94/09841.

International Search Report for International Application No. PCT/US94/09841.

*Primary Examiner*—Timothy V. Eley

*Attorney, Agent, or Firm*—Chilton, Alix & Van Kirk

[57] ABSTRACT

In an apparatus (10,100,300,400) for refining a low consistency fibrous slurry, which includes a plurality of refining zones (38,40; 188,128; 324,334; 411,413) within a casing, the improvement comprises providing a unique discharge flow path from each refining zone to a respective unique discharge line (56,58; 130,142; 308,310; 411,413) out of the casing, and means (57,59; 141,143; 344,346; 432,434) for differentially adjusting the flow rate in each discharge line. In accordance with the preferred embodiment of the invention, a divider (42,132,340) is provided between the casing and the rotor member, thus dividing the discharge between the two refining gaps, into two separate flow streams. The first and second gaps are monitored in any conventional manner. Under operating conditions, the flow control valves are adjusted for combined flow from the refiner casing as required by the production demands. However, the relative positioning between the two valves is adjusted until the refining gap measurements show equal gaps (within a pre-established tolerance) in the two refining zones.

23 Claims, 7 Drawing Sheets

DUAL ZONE REFINER WITH SEPARATED DISCHARGE FLOW CONTROL

BACKGROUND OF THE INVENTION

The present invention relates to the low and medium consistency refining of lignocellulosic material, and more particularly, to the control of the refining gap between relatively rotating refiner plates in such refiners.

Low consistency refiners for lignocellulosic material are used for developing fiber to increase surface area and fibrils and for cutting fibers to reduce their length. Low consistency refining was generally understood with respect to lignocellulosic material, as referring to a refiner fed by pumped slurry having a consistency of about 2–5% fiber. Modern pumping techniques accommodate consistency up to about 16% fiber (sometimes referred to as "medium consistency"). In these types of refiners, flow control is accomplished on the discharge of the machine, by a single throttling valve in a single discharge line. This is in contrast to the control of so-called high consistency refiners, where the feed is metered by a device upstream of the refiner. As used herein, "low consistency" should be understood as referring to pumped slurry with flow control at the discharge, as distinguished from high consistency with upstream metering.

Conventional two zone refiners maintain a common discharge from both refining zones and therefore, small differences in the refiner plate bar depth between the two zones or other factors can change the relative pumping capability of each zone. This can result in one zone pulling more than one-half of the total flow being supplied to the refiner which then provides uneven refining in the two zones since the thrust in the zones and the power applied is equal. Another deficiency is that the zone with the lower flow will have a smaller operating gap and therefore have a greater tendency for plate contact and increased wearing of the refining plate surfaces. This problem of uneven flow is particularly noticeable at material flows that are at the minimum volumetric capacity of the machine where operation may be desirable due to the lower refining intensities available at the lower flows.

SUMMARY OF THE INVENTION

The present invention is an improvement to low consistency refiners which treat fiber within a casing having a rotor member with first and second grinding faces opposed to respective third and fourth grinding faces, thereby establishing first and second grinding gaps, e.g., first and second refining zones. In such apparatus for refining a low consistency fibrous slurry, which includes a plurality of refining zones within a casing, the improvement comprises providing a unique discharge flow path from each refining zone to a respective unique discharge line out of the casing, and means for differentially adjusting the flow rate in each discharge line.

In accordance with the preferred embodiment of the invention, a divider is provided between the casing and the rotor member, thus dividing the discharge between the two refining gaps, into two separate flow streams. The two flow streams are discharged through separate nozzles from the refiner casing, and a separate flow control valve is installed in each discharge line. The first and second gaps are monitored in any conventional manner. In general, one face of each gap is movable axially relative to the opposed face of the same gap, i.e., the two gaps are variable. Under operating conditions, the flow control valves are adjusted for combined flow from the refiner casing as required by the production demands. However, the relative positioning between the two valves is adjusted until the refining gap measurements show equal gaps (within a pre-established tolerance) in the two refining zones.

The individual discharge from the two refining zones allows separate flow control for the two discharge streams and the flow can be adjusted until the refining gaps on each side are even. Adjustment of the outflow of refined fibers from the refiner changes the pressure in the refiner and between the grinding faces. By changing this pressure, the refining gaps can be increased or decreased, depending on whether outflow is increased or restricted. Restricting outflow drives up pressure and increases the refining gap. Allowing greater outflow results in decreased pressure and a smaller gap. The adjustment assures equal operating gaps. The refining action in the two zones is then assured of being equal resulting in a more constant pulp quality. Also, with the two refining zones being equal, it is feasible to operate the machine at a lower refining gap since one gap is not smaller than the other thus improving machine control and allowing higher potential refining capacity for the machine. Also, with equal refining gaps the potential for premature wearing of the refiner plates on the one side of the machine is eliminated. This improves refining plate life, thus lowering the cost of the refining plates, and limits the number of plate changes that need to be made, thus improving the machine availability and minimizing downtime. The invention also prevents changes in pulp quality as the plates wear.

It should also be understood that this configuration could be incorporated into machines with more than two refining zones, where again each of the refining gaps is monitored individually and adjusted by separate flow controls on respective separate discharges.

The invention may also be implemented in the embodiment of two refiners in series, where the split discharge flow from the first machine remains split and is fed to two separate sides of a second refiner. The second refiner may have a single or split discharge, feeding to a storage chest. In this embodiment, the control of discharge flow may be primarily concerned with equalization in the two discharge lines from the first refiner, so that the feed into each side of the second refiner (without the further assistance of pumps), would be equal. In other words, control on the first refiner would be to equalize the discharge flow, rather than to equalize refining gaps. The control on the two discharge lines of the second refiner, could be optimized for gap equalization, or flow equalization.

In alternative embodiments, the multiple refining gaps within the refiner can be substantially equalized without explicit gap measurement, but with a somewhat lesser degree of confidence, by differentially adjusting the valves on the respective dedicated discharge lines, to equalize either a measured pressure in each discharge line, or a measured flow rate in each discharge line. In the preferred control system, where direct gap measurements are taken, the differential adjustment in the discharge lines can be limited to avoid excessive adjustment which would result in the gap narrowing beyond a certain pre-established minimum value. In refiners where gap measurement is not made, or the adjustment on the discharge lines in accordance with the invention is not dependent on gap measurements, the operator would still achieve an advantage relative to conventional control.

It should be further appreciated that the present invention achieves gap equalization as a result of the variability of the gaps, to pressure imbalances within the refiner. In a number of refiners where the present invention may be utilized, the rotor is axially free floating. Thus, even if the stator plates are not adjustable during operation, the differential effect on the flow rate through each refining gap resulting from the differential adjustment of the valves in accordance with the invention, will produce axial realignment of the rotor, thereby achieving substantially equal gap width. For purposes of refining quality, the two most important factors are the energy power input (e.g. kilowatts) and the gap width. It can be appreciated that in some refiners, the stator plate is adjustable during operation and may also respond by moving axially as a result of the adjustments in differential flow rates in accordance with the present invention.

BRIEF DESCRIPTION OF THE DRAWINGS

These and other objects and advantages of the invention will be evident from the following description and accompanying drawings, in which.

DESCRIPTION OF THE PREFERRED EMBODIMENT

Figure 1:
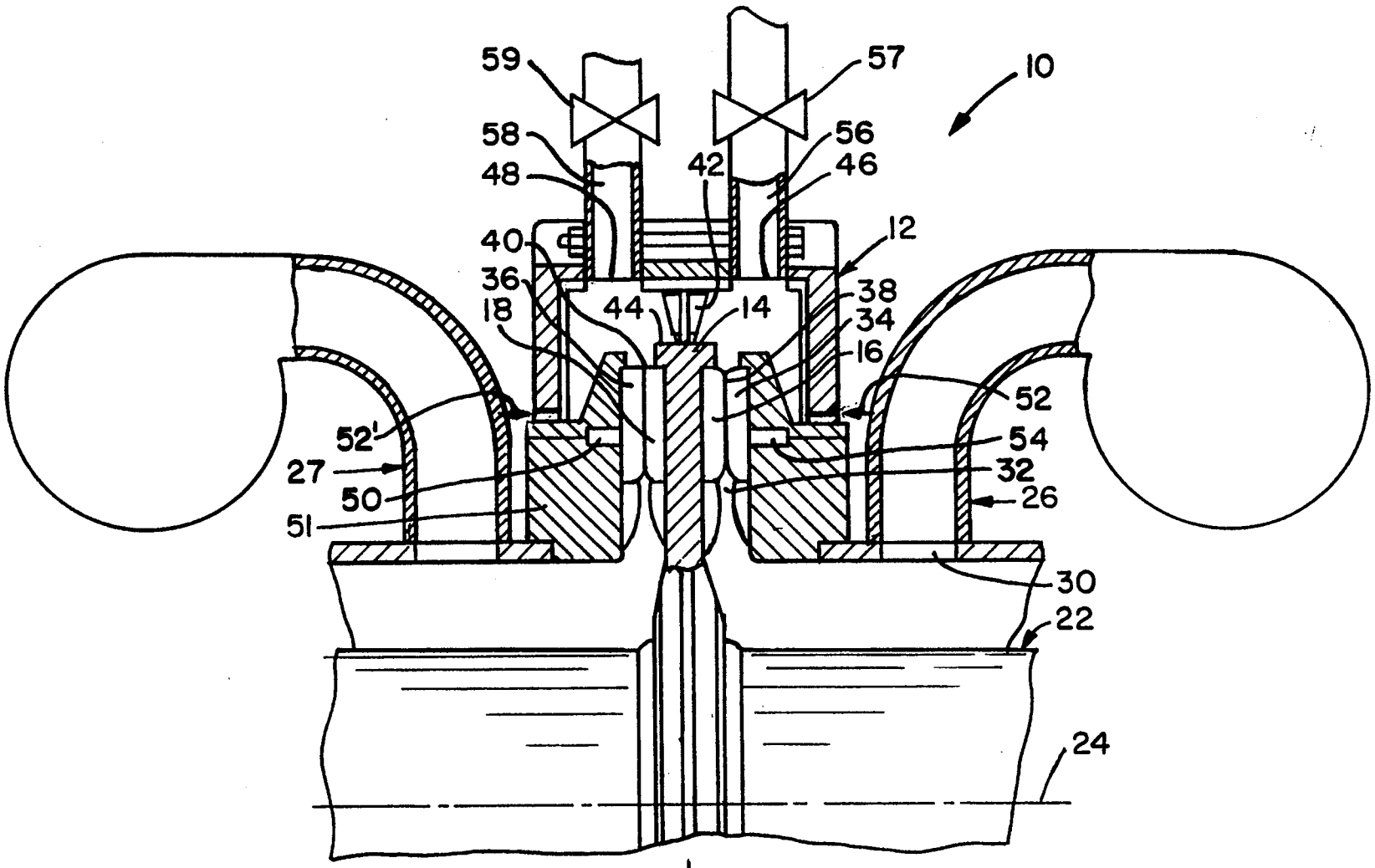
FIG. 1 is a side view, in section, of the central portion of one type of refiner having a flat central rotor with axial feeding and substantially radial refining in symmetric fashion about a vertical plane passing centrally through the rotor, as adapted with distinct discharge openings in the casing, in accordance with one embodiment of the present invention.

It should be understood that the present invention is applicable to a variety of refiners for mechanically treating a slurry of fibrous material, wherein the machine has at least two refining zones located substantially symmetrically on either side of a vertical plane perpendicular to the refiner shaft. A first refiner 10 of this type is shown in FIG. 1. A casing 12 has a substantially flat rotor 14 situated therein, the rotor carrying a first annular plate defining a first grinding face 16 and a second annular plate defining a second grinding surface 18. The rotor 14 is substantially parallel to and symmetric on either side of, a vertical plane indicated at 20. A shaft 22 extends horizontally about a rotation axis 24 and is driven at one or both ends (not shown) in a conventional manner. The refiner in FIG. 1 is in all respects pertinent to this disclosure, symmetric about plane 20, and therefore any structure described herein on one side of the plane, has counterpart structure on the other side of the plane.

A feed conduit 26 delivers a pumped slurry of lignocellulosic feed material through inlet opening 30 on either side of the casing 12. At the rotor, the material is re-directed radially outward through the transition region 32 whereupon it moves along the first grinding face 16 and a third grinding face 34 juxtaposed to the first face so as to define a first refining gap 38 therebetween. Similarly, on the other side of the rotor 14, material passes through the gap 40 formed between the second grinding face 18 and the juxtaposed grinding face 36.

A divider member 42 extends from the casing 12 to the periphery, i.e., circumference 44, of rotor 14, thereby maintaining separation between the refined fibers emerging from the first refining gap 38, relative to the refined fibers emerging from the second refining gap 40. The fibers from the first refining gap 38 are discharged from the casing through discharge opening 46, along discharge stream or line 56, whereas the fibers from the second refining gap 40 are discharged from the casing through opening 48 along discharge line 58.

It should be appreciated that the gaps 38, 40 are variable, in the sense that during the refiner operation, forces arise which tend to push the opposed faces 16,34 and 18,36, away from each other. Conventionally, the grinding faces 34,36 are mounted in stator rings which are urged inwardly, toward the rotor 14, by means of piston or other forces as indicated at 52,52'. The control of the gap width is an important aspect of producing fiber of desired quality. Accordingly, gap sensors such as shown at 50,54, can be provided to generate input signals to the controller for the stator movement indicated at 52.

Although the refiner structure is normally symmetric in the embodiment shown in FIG. 1, the widths of refining gaps 38,40 may not be equal, due for example, to the inherent fluctuations in the feed rates from the two sides of the rotor 14. In accordance with the present invention, differences in the gap widths 38,40, for example, as measured with sensors 50,54, are utilized to adjust at least one of the first and second flow rates 56,58, to thereby vary the width of at least one of the refining gaps. In the invention, the refining gap 40 is not regulated by controlling the stator 51, but by regulating the pressure in the refiner 10 and therefore on the grinding faces 16,18,34,36 by adjusting the outflow of refined fibers. In particular, at least one of the gap widths is adjusted so that the widths of the gaps 38,40, are equal, within a predetermined tolerance. This is preferably accomplished by a control valve 57,59 in each of the lines 56,58, responsive to the gap width sensor signals, in a manner to be described in greater detail in connection with FIGS. 2 and 3.

Figure 2:
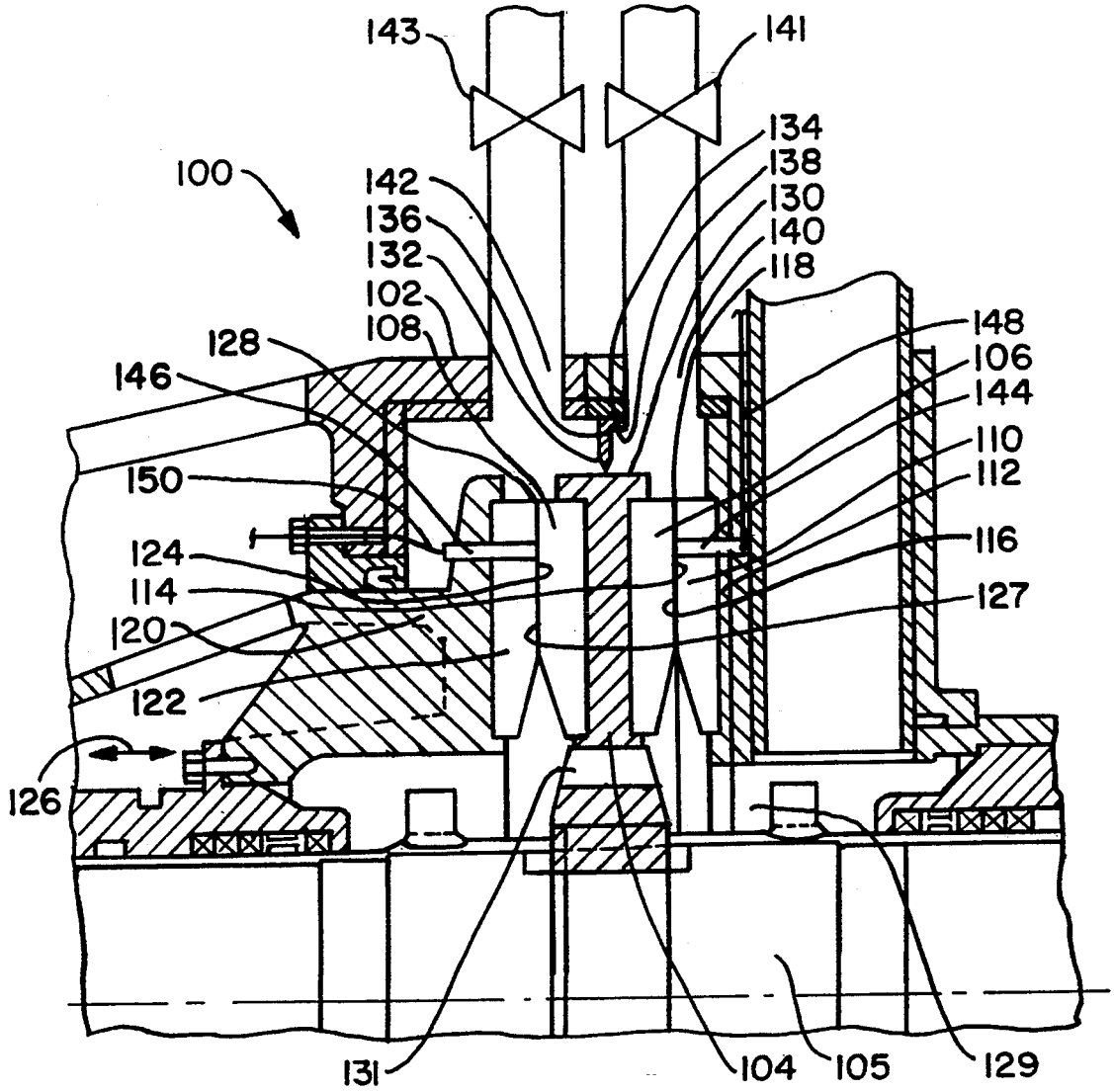
FIG. 2 is a section view similar to FIG. 1, for a second embodiment having a flat rotor between a fixed refining surface on one side and an axially adjustable refining surface on the other side, and the associated distinct casing discharge openings in accordance with a second embodiment of the invention.

FIG. 2 shows a second embodiment 100 of a refiner in accordance with the present invention, having a casing 102 with a rotor 104 driven by a shaft 105. The rotor 104 carries a first annular plate 106 and, on the opposite side, a second annular plate 108. A third grinding plate 110 is supported in fixed relation by a support member 112 which is in turn affixed to the casing 102. The grinding face 114 of plate 106 is juxtaposed with the grinding face 116 in plate 110, thereby defining a first refining gap 118. A stator member 120 on the opposite side of rotor 104, carries a stator plate 122 with grinding surface 124 which is juxtaposed with plate 108 with grinding surface 127 and forms a second refining gap 128 therebetween. The stator ring 120 is conventionally adjustable by hydraulic or other means, axially toward and away from the rotor 104, as shown at 126. The rotor 104, although rigidly supported by the shaft, is itself moveable axially, because the shaft is supported in bearings which enable the shaft to adjust axially in response to the pressure balance between gaps 128 and 118. Whereas in the embodiment of FIG. 1, the rotor 14 remains axially fixed and the two stator rings 51,51' are adjustable as shown at 54, in the embodiment of FIG. 2, the stator ring 120 and rotor 104 are axially adjustable as shown at 126, while plate 110 is fixed relative to casing 102.

It should also be appreciated that in the embodiment of FIG. 2, the feed material is pumped as a slurry to the right of the rotor. Passageways 129,131 provided at the base of the rotor, permit the feedstream to split between the first stream that passes radially upward through the first refining gap 118, and a second stream which, after passage through the rotor base, travels radially outward through refining gap 128. In the embodiment of FIG. 2, the first gap 118 is alternatively referred to as being on the motor end of the refiner, whereas the gap 128 is considered at the adjustment end of the refiner.

As in the embodiment of FIG. 1, a divider ring 132 extends annularly from the casing 102 to the circumferential periphery 130 of the rotor 104. In the embodiment of FIG. 2, the annular ring 132 is welded at 136 perpendicularly to a plurality of horizontally extending legs 134, through which bolts 138 are secured to the casing 102. The divider 132 therefore maintains separation of the refined fiber emerging gap 118 and flowing through the first discharge opening 140 in casing 102, and the refined fiber emerging from gap 128 for discharge through the second opening 142 in casing 102. Flow control for each discharge stream is achieved by valves 141,143. Gap sensors 144 and 146 are provided through the fixed plate 110 and the stator plate 122, for generating respective gap width signals along lines 148,150, respectively.

Figure 3:
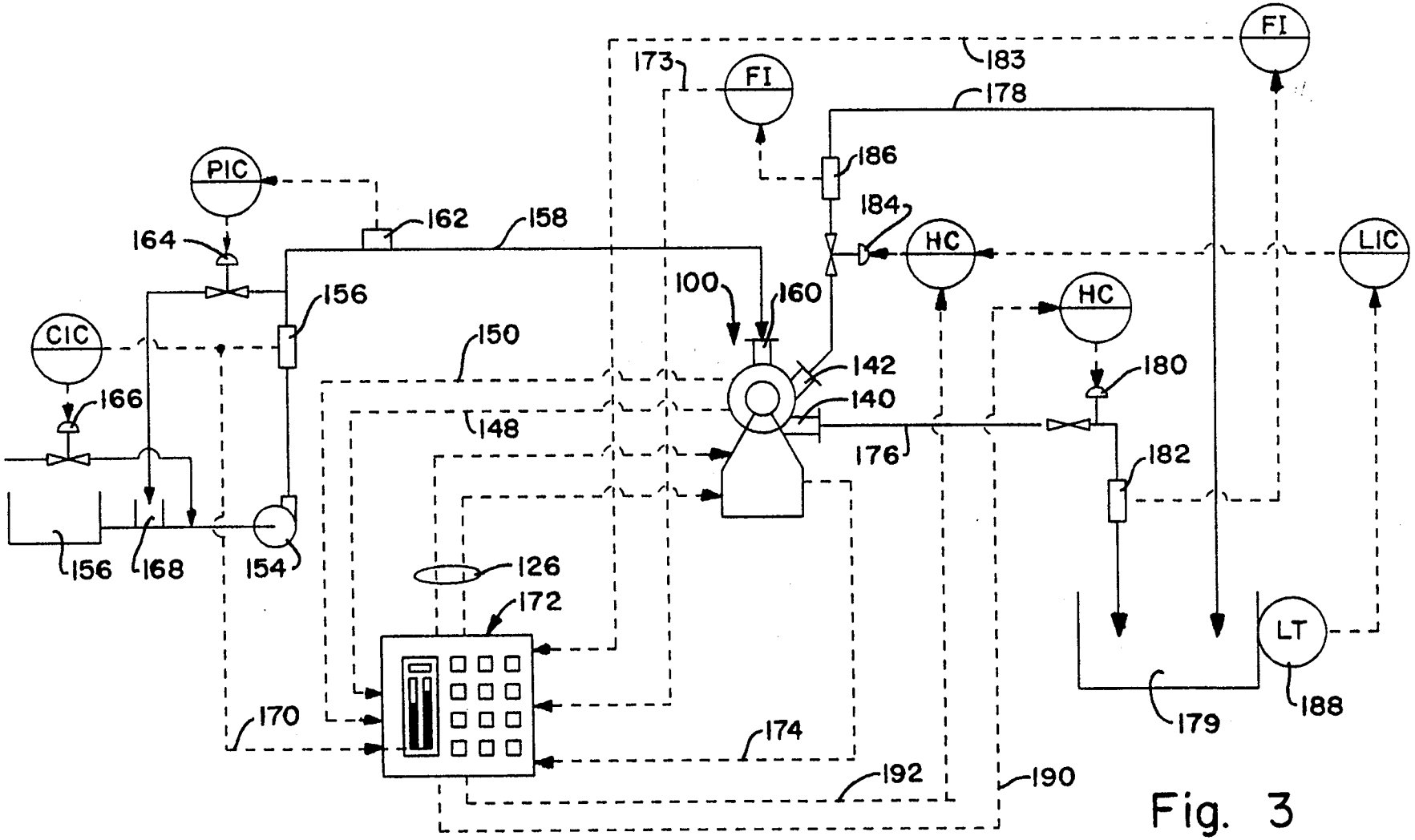
FIG. 3 is a schematic representation of the preferred control system for the refiner depicted in FIG. 2.

FIG. 3 shows the control system in the preferred embodiment of the invention associated with FIG. 2. The refiner 100 has the first discharge opening 140 and second discharge opening 142, and a feed material inlet nozzle 160. The material fed to the two refining gaps 118,128 of FIG. 2, would be delivered by a pump, with a portion passing radially through gap 128 and a portion passing through openings in the rotor 104 and thereupon entering gap 118, in a conventional manner.

The signals commensurate with the gap widths 118,128 of FIG. 2, are transmitted along lines 148,150, to a control center shown generally at 172 in FIG. 3. The control center 172 also receives signals commensurate with the flow rate through each of the discharge openings 140,142. For example, the discharge through opening 140 is conveyed through line 176, valve 180, and flow transmitter 182, whereupon the flow signal is delivered on the line 183 indicated by Flow 1 to control station 172. Similarly, the material discharged through opening 142 passes through valve 184 and flow transmitter 186 in line 178, with the flow signal entering the control station 172 along line 173 labelled Flow 2. Among other control functions, the control station 172 monitors that the total flow rate discharged from the refiner 100 (i.e., as measured by signals Flow 1 and Flow 2), is equal to the total flow demand at refined fiber chest 179 (within a predetermined tolerance). This total demand may be a function of the power imparted to the fibers as indicated by the electric utilization delivered along the kilowatt line 174.

In accordance with the present invention, the gap widths are equalized, within a predetermined tolerance, by adjusting one or both of the flow rates via the control signal 190 delivered to valve 180, and/or 192 delivered to valve 184. This gap control can be used with or without the stator axial adjustment, i.e., "open" or "close" control signal 126. In other words, conventional gap control logic can be utilized to control overall refiner load and therefore pulp quality, whereas the discharge flow control equalizes the gaps. In this respect, transmitter 188 controls the overall (total) openings of valves 180 and 184, and therefore the total flow. The gap measurement signals control the relative relationships of the valves. If gap 1 is smaller than gap 2, then discharge valve 180 will open and discharge valve 184 close an equal amount, to thereby equalize the gap and maintain the same total flow from the refiner.

Figure 4:
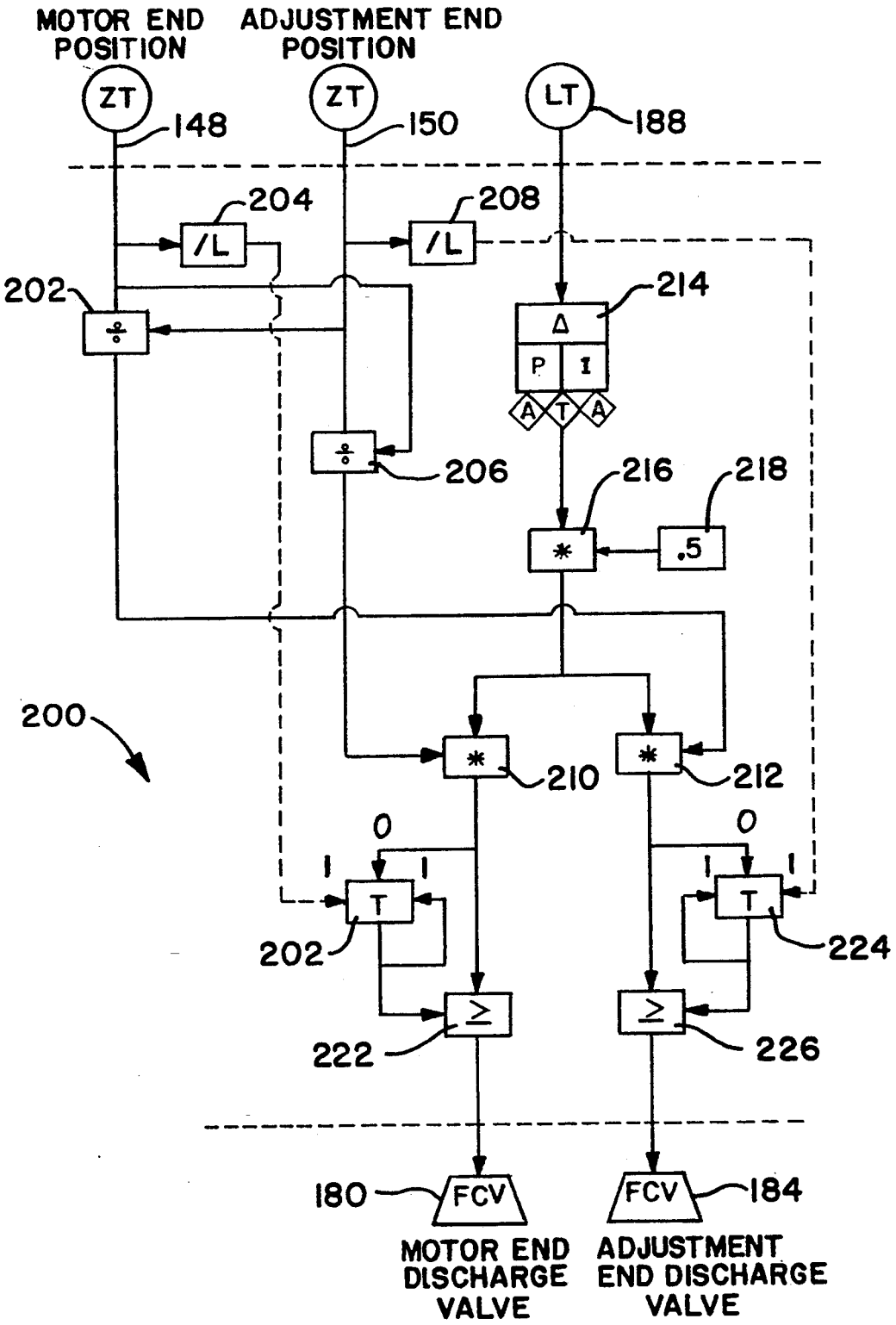
FIG. 4 is a schematic representation of the preferred control logic associated with the control system shown in FIG. 3.

This is preferably accomplished using the control logic 200 shown in FIG. 4. An output signal on 148 indicative of the motor end position is delivered to functional block 202, as is a signal from line 150 indicative of the adjustment end position. In block 202, the motor end position is divided by the adjustment end position and an output is delivered to functional block 212. The motor end position signal from line 148 is also delivered to functional block 204, which defines the minimum position limits. In a similar manner, functional block 206 receives signals from lines 148 and 150, to divide the adjustment end position by the motor end position, and delivers a signal to functional block 210. The minimum position limit for the adjustment end is also defined in block 208.

The level transmitter 188 from the refined chest 179 delivers a signal to the functional block 214, which is the normal control block, as would be used conventionally, to control the total flow by adjusting a throttle valve in the single discharge line of the refiner. In the present invention, the output from the control loop block 214 is delivered to a multiplies 216, which receives a multiplying factor (typically 0.5) from functional block 218. In the manner to be described below, this results in one-half of the output signal from the control loop block 214, ultimately going to each of the valves 180, 184, whereby the total output of the two valves would be the same as that of a single valve in a conventional control system.

Each of the functional blocks 210,212 multiplies the output from the division in blocks 206 and 202, respectively, by the valve control signal from functional block 216. The output of functional block 210 is further modified via the logic of functional blocks 220, 222, which imposes limits to prevent the valve 180 from closing beyond the minimum position limit established in functional block 204. A similar limit on valve 184 is achieved by the effect of functional blocks 224 and 226 on the output signal from functional block 212.

Therefore, the logic scheme described in connection with FIG. 4, maintains simultaneous control of the flow through valves 180 and 184, while partitioning the flow between these valves to equalize the refining gaps derived from the motor end position signals 148 and adjustment end position signals 150.

Other aspects of the control system are preferably also implemented as shown in FIG. 3. Starting at the left, unrefined feed material is supplied from a chest 152 along line 168 to pump 154 for delivery through a consistency regulator 156 and line 158 to the feed inlet nozzle 160 of the refiner 100. A pressure sensor 162 in line 158 provides an input signal by which a valve 164 affects the pressure in line 168. In response to the consistency regulator signal from 156, dilution water may be added through valve 166 to the feed material in line 168. The consistency as measured at 156 is also preferably an input along line 170, to the control station 172.

The present invention is not specifically directed to the logic or algorithm associated with relating the pressure in line 158, the consistency as delivered in line 170, the power as sensed through line 174, and the total flow of the refiner output, to the quality or other desired characteristics of the refined fiber. Rather, the invention is directed to a secondary type of control, in that once the total flow and other conditions are specified, the gap width will be adjusted to be equal, within a predetermined tolerance, by adjustment of valves 184 and 180.

Figure 5:
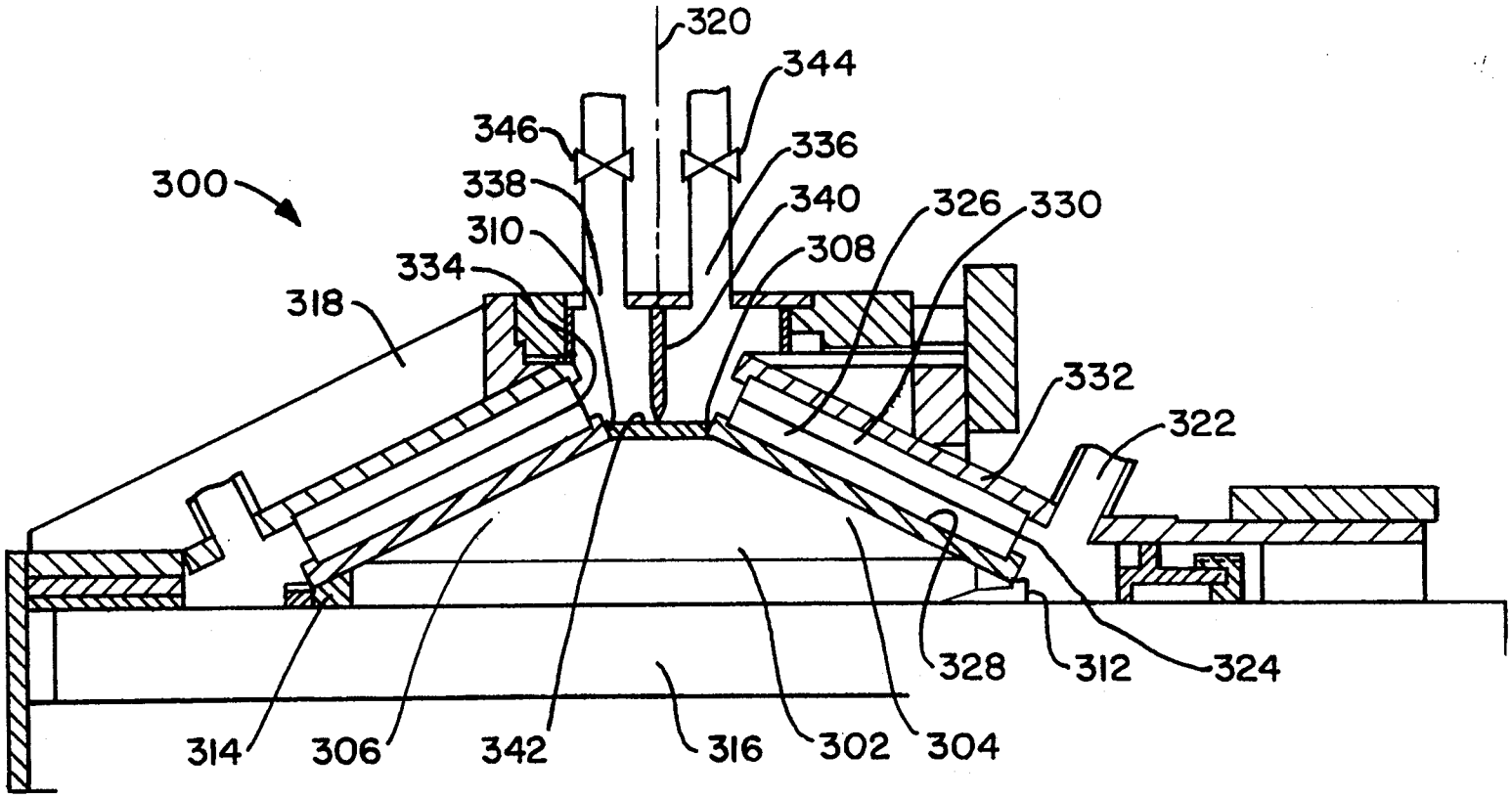
FIG. 5 is a section view of a portion of a third type of refiner in accordance with the present invention, wherein the rotor member has the form of two converging cones, each conical refining zone having its own associated discharge opening in the casing.

FIG. 5 shows another refiner embodiment 300, which for convenience, will be referred to as a converging conical refiner. The rotor 302 is in the shape of two symmetric frustroconical portions 304,306 connected near their larger diameter ends 308,310, with the bases of the smaller diameter ends 312,314 connected to shaft segments 316. The rotor 302 is situated within the casing shown generally at 318, for rotation about the horizontal axis of the shaft.

The refiner 300 is symmetric about the vertical plane 320 passing through the rotor, so that only one side thereof will be further described herein. Feed material enters the refiner through inlet 322, whereupon it is redirected at the smaller diameter portion of the rotor, into the conical refining zone or gap 324 between the rotating plate 326 carried by the conical surface 328 of the rotor, and the stator plate 330 which is rigidly supported by the casing at 332. Refined fiber also emerges from the refining gap 334 on the other conical portion of the rotor 302.

Opening 336 in the casing discharges the fiber emerging from gap 324, and opening 338 discharges the fiber emerging from gap 334. As in the previously-described embodiments, a divider 340 extends from the casing to a cylindrical portion at the apex 342 of the rotor, on the plane 320, for separating the two flow streams of refined fiber. Control valves 344,346 are provided in the respective discharge lines.

Those familiar with the present technology, can appreciate the ready adaptation of the control system shown in FIG. 3, for use with the refiner embodiment 10 shown in FIG. 1, and refiner embodiment 300 shown in FIG. 5.

Figure 6:
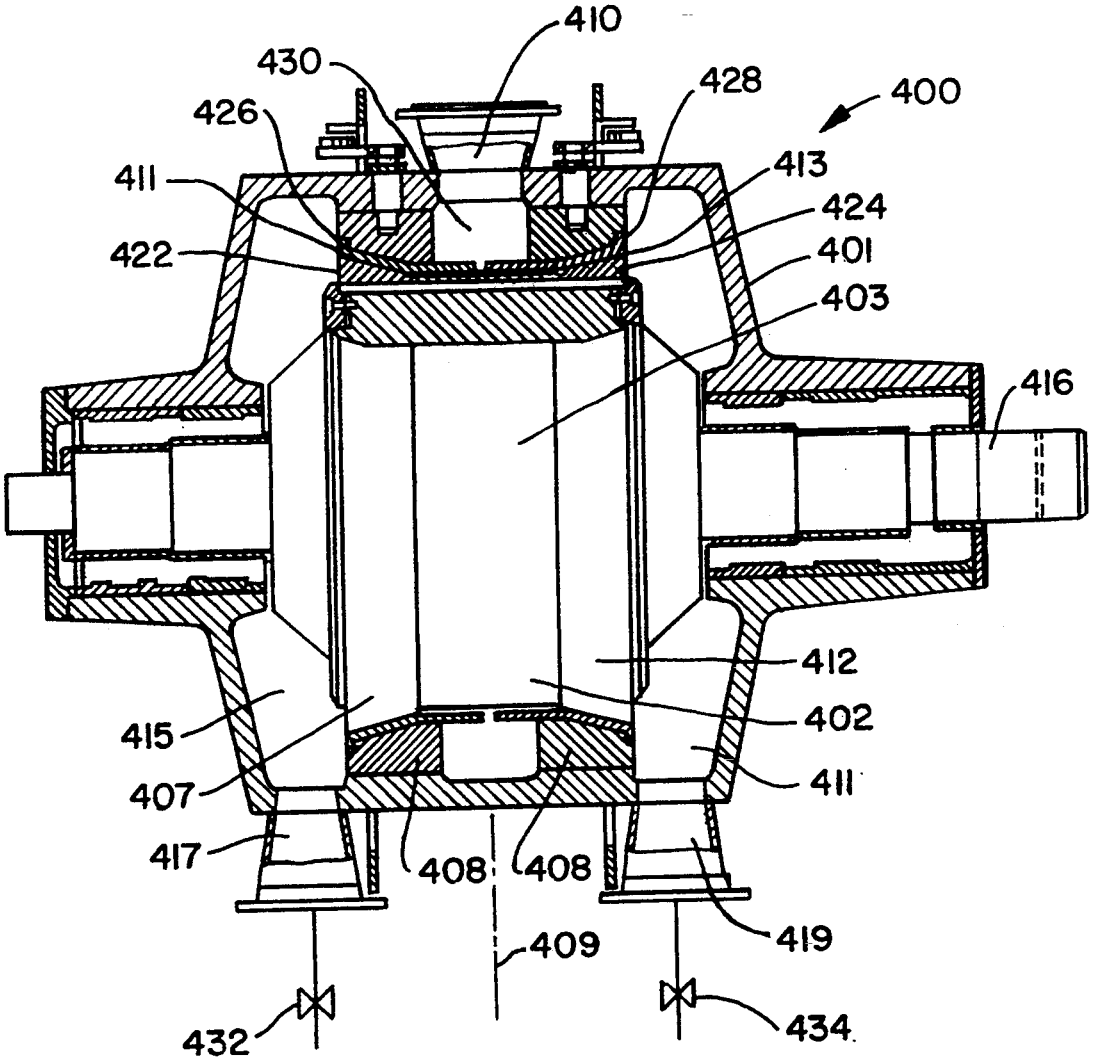
FIG. 6 is a section view of a portion of a fourth type of refiner in accordance with the present invention, wherein the rotor member has the form of two diverging cones, each conical refining zone having its own associated discharge opening in the casing.

The invention may be incorporated into yet another mechanical configuration, such as the diverging conical refiner 400 shown in FIG. 6. In this embodiment, a rotor 402 is supported by a rotatable shaft 416 within a casing 401. The rotor has the form of two frustoconical outer portions 407,412 connected at their minor diameters, on either end of a cylindrical center portion 403, about a plane of symmetry 409 passing through the central portion. The feed slurry is introduced along the plane of symmetry 409 through inlet conduit 410, and passes axially away from the plane of symmetry in each direction, toward the conical, outer portions. The conical portions of the rotor carry respective rotating refining plates 422,424, whereas stator plates 426,428 are supported by the casing, as by stator support rings 408.

The material flow is therefore in two opposite directions, away from the plane of symmetry 409, whereby the outflow from the first and second refining gaps 411,413 occurs at the major diameters of the outer portions 407, 412.

In the illustrated embodiment, the stator rings 408 provide fluid isolation between the inlet 410 and associated annulus 430, and the two discharge regions 415, at the major diameters of the rotor member. In this manner, isolation is maintained between the outflows emerging from the first refining gap 411 through a first discharge opening 417 in the casing, and the outflow emerging from the second refining gap 413 for discharge through a second discharge opening 419 in the casing. Valves 432,434 are provided as in the previously described embodiments.

Figure 7:
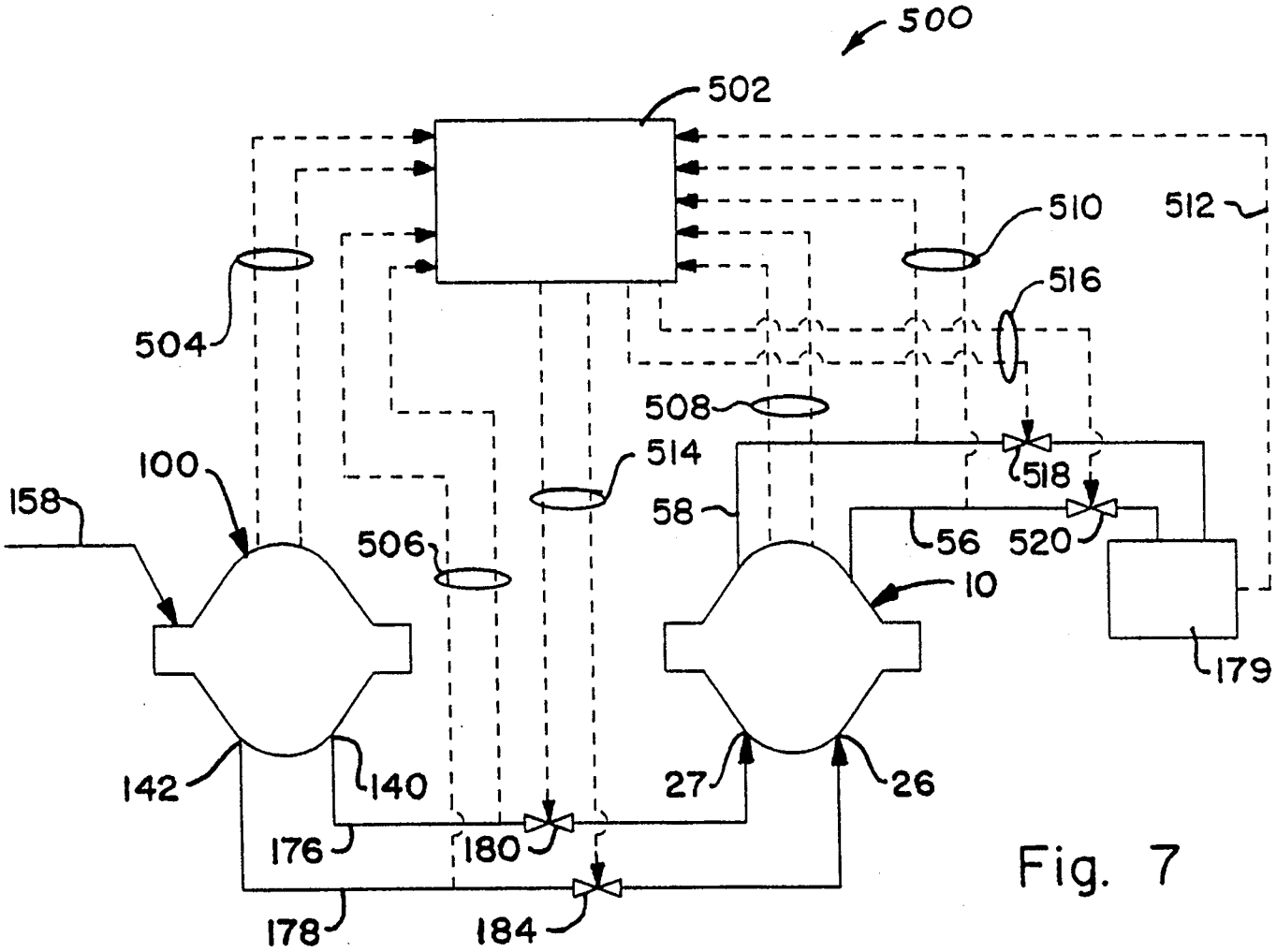
FIG. 7 is a schematic representation of a refiner system in which two refiners in series have the distinct discharge lines in accordance with the present invention.

The invention may also be implemented with a priority on equalizing the discharge flow from each of the refining gaps, in situations such as represented in FIG. 7. A system 500 comprising two (or more) refiners in series, such as 100 (see FIG. 1), or 400 (see FIG. 6) are fed from a single feedstream, but deliver discharge flows in two distinct lines leading to distinct feed inlets in a second refiner such as 10 (FIG. 1) or 300 (FIG. 5).

In this configuration, a main slurry feed line 158 introduces the feed to refiner 100, where the output of the two refining gaps emerge from the refiner at 140 and 142, respectively, for transfer downstream along lines 176,178. The material in line 176 passes through valve 180, and is introduced into refiner 10 at inlet 27, whereas the material in line 178 passes through 184 and is introduced into refiner 10 at inlet 26. In refiner 10, the material at inlet 27 and 26 is further refined in respective distinct refining zones, and discharged from the refiner along respective discharge lines 58,56. The discharged material passes respectively through valves 518 and 520 to the refined storage chest 179.

FIG. 7 also shows a simplified adaptation of the control system of FIG. 3, centered about the control station 502. Signals commensurate with the gap widths in refiner 100, are delivered over lines 504 to controller station 502, along with any other data that may be used in conventional control techniques. In addition, the respective flow rates in lines 176 and 178 are delivered along signal paths 506 to the controller station 502. In like fashion, signals commensurate with the refining gap widths and other relevant data from the refiner 100, are delivered along signal paths 508 to the control station 502, and the discharge flow rates in lines 58,56 are similarly delivered along data paths 510 to station 502. A level signal or the like is also transmitted from the storage chest 179, along data path 512, to station 502.

Control signals based on the data acquired along the foregoing data paths, are then delivered along paths 514 to valves 180 and 184, and along paths 516 to valves 518 and 520. As can be appreciated by the practitioners in this field, the system depicted in FIG. 7 requires, during steady state operation, that the total flow delivered to refiner 100 along main feedline 158, equal the total flow emerging from valves 518 and 520, which in turn should be commensurate with the maintenance of the desired level of material in the storage chest 179. Given this constraint, the system in accordance with the present invention, provides flexibility in optimizing performance by achieving substantially equal gap widths in one or both refiners, or substantially equal flow rates in each gap of one or both refiners, while satisfying the overall system total flow requirements.

It should also be appreciated that in another implementation of the invention, the data lines 506 and/or 510 can include measurements of pressure, rather than flow rate, in lines 176,178,58, and 56. In this embodiment, the control station 502 would, for example, maintain the relationship of valves 180 and 184, to maintain equal pressure in lines 176,178, upstream of the valves, i.e., thereby equalizing the discharge pressure of each refining gap associated with discharge openings 140,142, respectively. Such pressure equalization could be achieved in one or both of the refiners shown in the system of FIG. 7, or with respect to any of the individual refiners shown in FIG. 1,2,5, or 6. A control logic analogous to that shown in FIG. 4 could readily be implemented, to equalize the pressure in each discharge line, while maintaining the desired total flow.

The control schemes described above could be adapted by those skilled in this field, for use in a refiner having more than two refining zones. One such refiner is shown in U.S. Pat. No. 4,783,014, the disclosure of which is hereby incorporated by reference. The refiner has six refining zones, defined by three axially spaced apart rotating discs alternating with stator rings. The refiner disclosed in said patent, would of course be modified to include divider rings between each refining zone, and a separate discharge opening and associated valve, for each zone. Individual control of the flow in each refining zone, or the discharge pressure for each refining zone, could readily be implemented, whether or not the system includes the gap width adjustment aspect of the present invention.

I claim:

1. In an apparatus for refining a low consistency fibrous slurry, which includes means for introducing a fibrous slurry into a plurality of fiber refining zones within a casing, the improvement comprising:

a unique discharge flow path from each fiber refining zone to a respective unique discharge line out of the casing; and means in the discharge lines for differentially adjusting the flow rate in each discharge line while maintaining the total flow rate of all discharge lines equal to a predetermined value.

2. The apparatus of claim 1, wherein the means for adjusting differentially adjusts the flow in each discharge line to equalize a particular operating parameter associated with each refining zone.

3. The apparatus of claim 2 wherein the operating parameter is flow rate in the discharge flow path from each fiber refining zone.

4. The apparatus of claim 2, including means for sensing the pressure in each discharge flow path, and wherein said operating parameter is said sensed pressure.

5. The apparatus of claim 2, including means for sensing a variable dimension of each refining zone, and wherein said operating parameter is said variable dimension.

6. A refiner for treating a low consistency fibrous slurry of feed material, comprising:

a casing;

a rotor member situated within the casing and having a first plurality of grinding faces;

a shaft penetrating the casing and connected to the rotor member, for spinning the rotor member about a rotation axis;

means within said casing, forming a second plurality of grinding faces juxtaposed with said first plurality of grinding faces and thereby defining a plurality of refining gaps therebetween;

means for directing said feed material into the plurality of refining gaps, whereby each refining gap treats feed material and has a respective outflow rate;

means within the casing for directing the outflow from each refining gap, to a unique discharge line out of the casing;

a control valve situated in each discharge line; and means for selectively controlling said valves to differentially affect the flow rates through the discharge lines.

7. The refiner of claim 6, including means for measuring each grinding gap and generating respective gap width signals, and wherein said means for controlling said valves is responsive to the gap width signals.

8. The refiner of claim 7, wherein the means for controlling said valves differentially affects the flow rates to substantially equalize the gaps as measured by said means for measuring.

9. The refiner of claim 6, including means for measuring the flow rate through each discharge line and generating respective flow rate signals, and wherein said means for controlling said valves is responsive to the flow rate signals.

10. The refiner of claim 9, wherein the means for controlling said valves differentially affects the flow rates to substantially equalize the flow rates as measured by said means for measuring.

11. The refiner of claim 6, including means for measuring the pressure in the discharge lines upstream of the valves and generating respective pressure signals and;

wherein said means for controlling said valves is responsive to the pressure signals.

12. The refiner of claim 11, wherein the means for controlling said valves differentially affects the pressures to substantially equalize the pressures as measured by said means for measuring.

13. A refiner for mechanically treating fibrous slurry, comprising:

a casing;

a rotor member situated within the casing and having first and second grinding faces on respective sides of a vertical plane passing through the rotor member;

a horizontal shaft penetrating the casing and connected to the rotor member perpendicularly to said plane, for spinning the rotor member about a horizontal rotation axis;

means within said casing, forming a third grinding face juxtaposed with said first grinding face and thereby defining a first variable width refining gap therebetween;

means within said casing, forming a fourth grinding face juxtaposed with said second grinding face and defining a second variable width refining gap therebetween;

means for directing feed material into the first and second refining gaps simultaneously, whereby a first outflow rate discharged from the casing from the first refining gap varies with the first refining gap width and a second outflow rate discharged from the casing from the second refining gap varies with the second refining gap width;

means for measuring the first and second refining gap widths and generating respective first and second gap width signals; and control means responsive to said gap width signals, for adjusting at least one of the first and second outflow rates to thereby vary the width of at least one of said refining gaps.

14. The refiner of claim 13, wherein said control means compares the gap width signals and generates a control signal for adjusting at least one of the outflow rates until the compared gap width signals are equal within a predetermined tolerance.

15. The refiner of claim 14, including means for generating a total measured flow rate signal commensurate with the total outflow rate from all refining gaps after discharge from said casing;

means for generating a demand signal commensurate with a desired total flow rate discharged from said casing; and wherein said control means is also responsive to the measured total flow rate signal and the demand signal, for adjusting said outflow rates until the measured total flow rate signal and the demand signal are equal within a predetermined tolerance.

16. The refiner of claim 13, wherein the outflow from each refining gap exits the casing through a respective discharge line and the control means employs a valve in at least one of the discharge lines to adjust at least one of the first and second outflow rates.

17. The refiner of claim 13, including divider means extending between the casing and the rotor member, for maintaining isolation between the outflow emerging from the first refining gap for discharge through a first discharge opening in the casing and the outflow emerging from the second refining gap for discharge through a second discharge opening in the casing;

first and second valves downstream of the first and second discharge openings, respectively; and wherein said control means adjusts said flow rates by adjusting at least one of said valves.

18. The refiner of claim 13, wherein the rotor member is substantially in the form of a two-sided disc oriented perpendicularly to the axis and having symmetric first and second refining gaps on either side thereof.

19. The refiner of claim 13, wherein the rotor member is a substantially flat disc having grinding plates secured annularly on each axial side thereof, forming said first and second grinding faces, said third grinding face is formed by a plate which is rigidly and immovably secured to said casing, said fourth grinding face is formed on a plate supported in the casing for variable axial displacement, and said shaft is axially displaceable to thereby axially adjust the first grinding face of the rotor member relative to said third grinding face.

20. The refiner of claim 13, wherein the rotor member has the form of two frustoconical members joined together at their larger diameter and connected to said shaft near their minor diameters, so as to be symmetric about a plane of symmetry passing through said major diameters, whereby the outflows emerging from said first and second refining gaps are directed toward said plane of symmetry, and divider means are provided extending substantially annularly in said plane of symmetry, for obtaining isolation between outflows emerging from the first refining gap for discharge through a first discharge opening in the casing and the outflows emerging from the second refining gap for discharge through a second discharge opening in the casing.

21. A refiner for mechanically treating fibrous slurry, comprising:

a casing;

a rotor member situated within the casing and having first and second grinding faces on respective sides of a vertical plane passing through the rotor member;

a horizontal shaft penetrating the casing and connected to the rotor member perpendicularly to said plane, for spinning the rotor member about a horizontal rotation axis;

means within said casing, forming a third grinding face juxtaposed with said first grinding face and thereby defining a first variable width refining gap therebetween;

means within said casing, forming a fourth grinding face juxtaposed with said second grinding face and defining a second variable width refining gap therebetween;

means for directing feed material into the first and second refining gaps simultaneously, whereby a first outflow rate discharged from the casing from the first refining gap varies with the first refining gap width and a second outflow rate discharged from the casing from the second refining gap varies with the second refining gap width;

divider means extending between the casing and the rotor member, for maintaining isolation between the outflow emerging from the first gap for discharge through a first discharge opening in the casing and the outflow emerging from the second refining gap for discharge through a second discharge opening in the casing;

means for measuring the first and second outflow rates discharged through said openings in the casing and generating respective first and second discharge flow rate signals; and control means responsive to said flow rate signals, for adjusting at least one of the first and second outflow rates to equalize said outflow rates within a predetermined tolerance.

22. The refiner of claim 21, wherein the control means employs a valve downstream of at least one discharge opening, to adjust at least one of the first and second outflow rates.

23. The refiner of claim 21, including first and second valves associated with the first and second discharge openings, respectively;

wherein said control means adjusts said flow rates by adjusting at least one of said valves.

* * * * *